US011976909B2

(12) United States Patent
Findlay et al.

(10) Patent No.: US 11,976,909 B2
(45) Date of Patent: May 7, 2024

(54) CASE PRESS

(71) Applicant: AMP Annealing Limited, Pukekohe (NZ)

(72) Inventors: Alexander Findlay, Pukekohe (NZ); Matthew Findlay, Pukekohe (NZ)

(73) Assignee: AMP ANNEALING LIMITED, Pukekohe (NZ)

( * ) Notice: Subject to any disclaimer, the term of this patent is extended or adjusted under 35 U.S.C. 154(b) by 47 days.

(21) Appl. No.: 17/323,503

(22) Filed: May 18, 2021

(65) Prior Publication Data

US 2022/0026188 A1 Jan. 27, 2022

Related U.S. Application Data

(60) Provisional application No. 63/054,821, filed on Jul. 22, 2020.

(51) Int. Cl.
*F42B 33/00* (2006.01)

(52) U.S. Cl.
CPC ..... *F42B 33/001* (2013.01)

(58) Field of Classification Search
CPC ..... F42B 33/001
USPC ..... 86/43
See application file for complete search history.

(56) References Cited

U.S. PATENT DOCUMENTS 2,533,279 A * 12/1950 Moore ..... B30B 1/24 73/862.542
3,036,488 A * 5/1962 Bihler ..... F42B 33/10 86/26
3,240,104 A * 3/1966 Bachhuber ..... F42B 33/004 86/39
3,483,792 A * 12/1969 Williams ..... F42B 33/004 86/27
3,973,465 A * 8/1976 Bachhuber ..... F42B 33/04 86/36
4,028,989 A * 6/1977 Vassallo ..... F42B 33/06 86/49
4,048,899 A * 9/1977 Bachhuber ..... F42B 33/12 86/39
4,078,472 A * 3/1978 Simpson ..... F42B 33/10 86/27
7,562,622 B2 * 7/2009 Babiel ..... B30B 15/10 100/35
10,619,984 B2 4/2020 Pruett et al.
11,609,076 B2 3/2023 Pruett et al.
2005/0039595 A1 * 2/2005 Bolhassani ..... F42B 5/24 86/24

(Continued)

OTHER PUBLICATIONS

Thetargetmaster, "Seating force gauge", Jun. 8, 2018, YouTube, Entire Video, <https://www.youtube.com/watch?v=c9DBuQrGZg8>. (Year: 2018).*

(Continued)

*Primary Examiner* — Jonathan C Weber
(74) *Attorney, Agent, or Firm* — Finnegan, Henderson, Farabow, Garrett & Dunner LLP

(57) ABSTRACT

A case press is disclosed. The case press has a ram moveable relative to a base by an electric actuator. The case press also has a sensor for determining relative movement between the ram and the base. Further, the case press has a load cell for measuring a load exerted by the ram on a die positioned, in use, between the ram and the base.

14 Claims, 8 Drawing Sheets

(56) References Cited

U.S. PATENT DOCUMENTS

| | | | | |
|---|---|---|---|---|
| 2007/0022870 | A1* | 2/2007 | Bond | F42B 33/002 86/24 |
| 2016/0076864 | A1* | 3/2016 | Dykstra | F42B 33/04 86/36 |
| 2016/0084624 | A1* | 3/2016 | Pruett | F42B 33/004 86/23 |
| 2019/0368848 | A1* | 12/2019 | Carter | F42B 33/0207 |
| 2021/0364262 | A1 | 11/2021 | Carter et al. | |

OTHER PUBLICATIONS

Findlay, et al.; YouTube video titled "Bullet seating press with load cell and auto drive"; https://www.youtube.com/watch?v=B88I3XT0oME&feature=emb_rel_end; uploaded to YouTube Sep. 18, 2019.

* cited by examiner

CASE PRESS

CROSS-REFERENCE TO RELATED APPLICATION

This application is based on and claims benefit of priority of U.S. Provisional Patent Application No. 63/054,821, filed Jul. 22, 2020, the entire contents of which are incorporated herein by references.

FIELD OF INVENTION

The present invention relates to an electrically operable case press for assembling ammunition, and in particular, but not exclusively, to a case press which provides an indication of a condition of a shell.

BACKGROUND TO THE INVENTION

Many shooting enthusiasts prefer to assemble their own cartridges rather than using prefabricated ammunition. Self-assembled cartridges are often less expensive than prefabricated equivalents, particularly if previously used cases (often referred to collectively as "brass") are re-used. In addition, self-assembly allows customisation and quality control over the finished cartridge. This may be particularly important if the cartridge is to be used in competition.

Cartridges are assembled using a case press (sometimes called a "reloading press"). The case (with a powder charge in place) and bullet are mounted in a die. The die has a portion which presses the bullet, under action of the press, into the mouth of the case in an interference fit. Typically, the die is driven by hand, that is, the user provides the motive force to the die by operating a lever which actuates the die through a suitable mechanical linkage.

An experienced user of a case press can determine the state of the case, particularly the neck/shoulder region of the case, by the feel of the press as the bullet is pressed into the case. However, this can be susceptible to user error. For example, the feel may vary depending on how fast the user pushes the bullet and case together. Also, there are many factors that affect the feel of the press as the bullet is pressed into the case, for example the malleability of the case, the tension in the neck of the case, the state of surfaces of the case, and the size of the mouth. Even a highly experienced user may find it difficult to distinguish these factors from one another through feel when pressing a bullet into a case.

These issues may cause the user to gain an incorrect understanding of the state of the case or the assembled cartridge, which can lead to improper assembling and/or malfunctions, or to unwanted variations in the final cartridge.

OBJECT OF THE INVENTION

It is an object of the invention to provide a case press which will overcome or ameliorate at least one problem with the case presses of the prior art.

Alternatively, it is an object of the invention to at least provide the public with a useful choice.

SUMMARY OF THE INVENTION

According to one aspect of the invention there is provided a case press comprising a ram moveable relative to a base by an electric actuator and a load cell for measuring a load exerted by the ram on a die positioned, in use, between the ram and the base.

According to another aspect of the invention there is provided a case press comprising a ram moveable relative to a base by an actuator, a sensor for determining relative movement between the ram and the base, and a load cell for measuring a load exerted by the ram on a die positioned, in use, between the ram and the base.

Preferably the actuator is an electric actuator.

Preferably, the electric actuator comprises an electric motor.

Preferably the case press comprises a drive mechanism for driving the ram, wherein the drive mechanism comprises a cam which is configured to be rotated by the actuator.

Preferably the sensor comprises a rotary sensor.

Preferably the rotary sensor is configured to measure an angular position of the cam.

Preferably the case press comprises a connecting rod, wherein the cam bears against a first end of the connecting rod.

Preferably the connecting rod is biased toward the cam.

Preferably the connecting rod comprises a roller at the first end thereof, wherein the cam bears on the roller.

Preferably the ram is connectable to a second end of the connecting rod, distal the first end.

Preferably the ram is releasably connectable to the second end of the connecting rod.

Preferably the load cell is provided between the base and the die.

Preferably the base comprises a recess and the load cell is provided within the recess.

According to an aspect of the invention, there is provided a case press comprising a frame having a base and a support portion connected to the base, the base comprising or configured to engage a die, the case press further comprising an actuator supported by the support portion, a ram moveable by the actuator toward the die, a load cell for measuring a load exerted on the die and a sensor for determining movement of the ram relative to the base.

According to an aspect of the invention, there is provided a case press comprising a frame having a base and an upright connected to the base, the base comprising or configured to engage a die, the case press further comprising an actuator connected to the upright, a ram moveable by the actuator toward the base, a load cell for measuring a load exerted on the ram and a sensor for determining movement of the ram relative to the base.

According to a further aspect of the invention there is provided a system for assembling a cartridge comprising a case press as described in any one of the preceding 16 paragraphs and a visual output device configured to display a representation of an output from the load cell at a plurality of points during insertion of the bullet.

Preferably the visual output device displays a graphical representation of a relationship between force applied by the die and displacement of the die.

According to a further aspect of the invention, there is provided a method of generating a graphical display of insertion force relative to insertion distance as a bullet is inserted into a case by a case press, the case press comprising a ram moveable relative to a base by an actuator, a sensor for determining relative movement between the ram and the base, and a load cell for measuring a load exerted on the ram on a die positioned, in use, between the ram and the base, the method comprising simultaneously obtaining a position measurement from the sensor and a force measurement from the load cell at a plurality of times during the operation of the case press, and displaying the measurements in a graphical format.

Further aspects of the invention, which should be considered in all its novel aspects, will become apparent to those skilled in the art upon reading of the following description which provides at least one example of a practical application of the invention.

BRIEF DESCRIPTION OF THE DRAWINGS

One or more embodiments of the invention will be described below by way of example only, and without intending to be limiting, with reference to the following drawings, in which.

BRIEF DESCRIPTION OF EMBODIMENTS OF THE INVENTION

Figure 1:
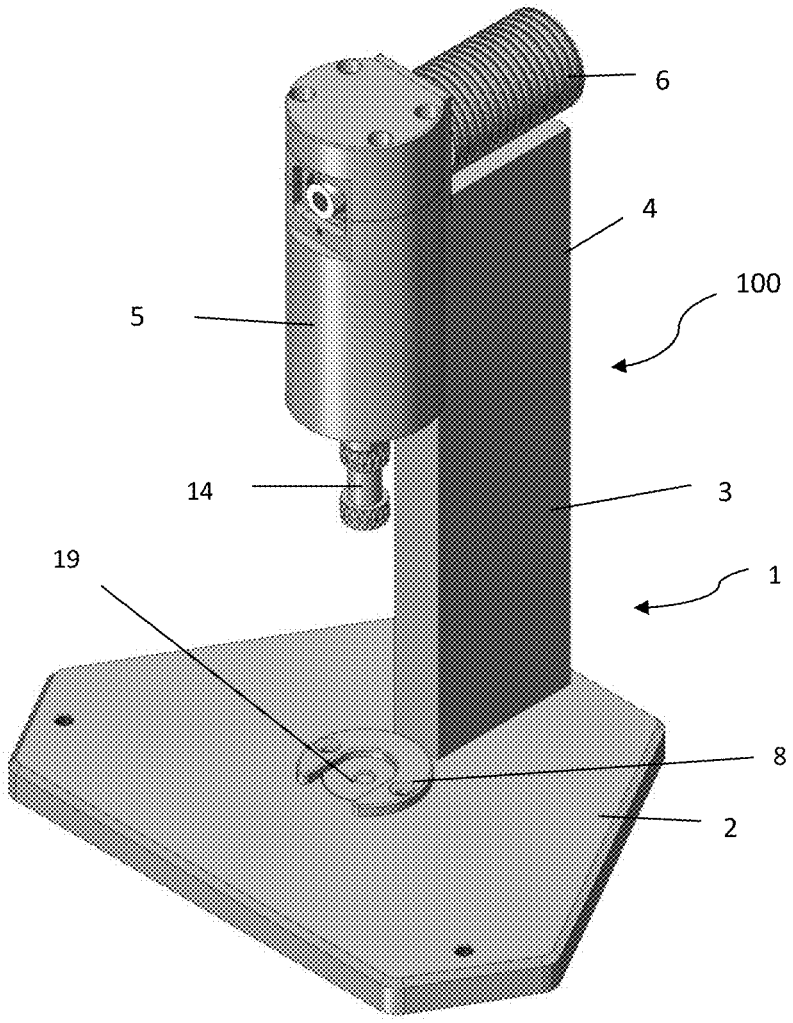
FIG. 1 is a perspective view of a case press of the present invention, with a sensor removed.
Figure 2:
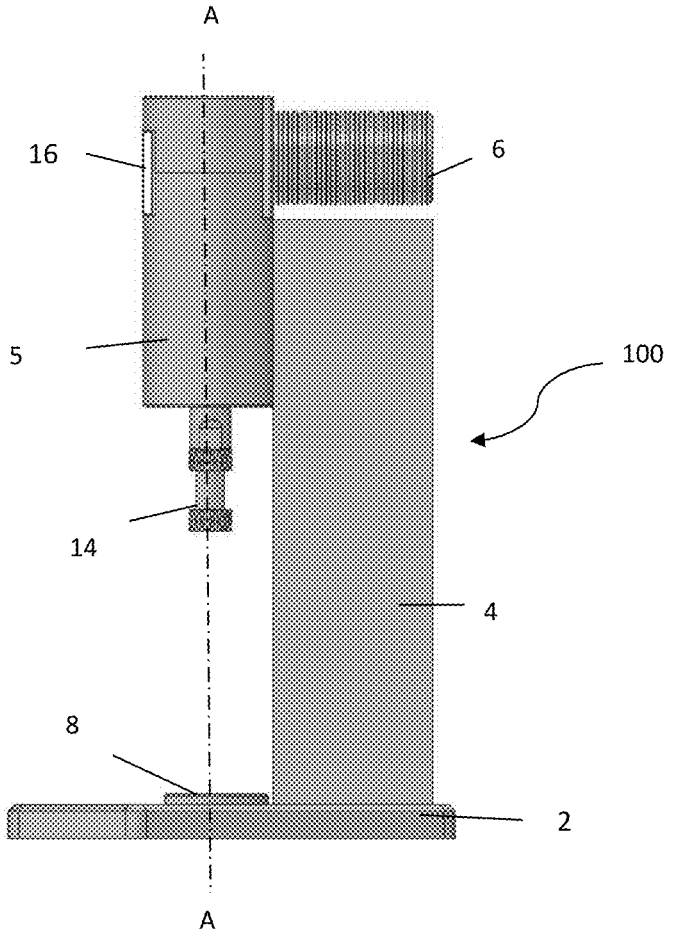
FIG. 2 is a side view of the case press of FIG. 1, with the sensor shown.

Referring first to FIGS. 1-4, and in particular FIG. 1, a case press 100 according to one form of the technology is generally referenced by arrow 100. The case press 100 comprises a frame 1. The frame 1 has a base 2 and a support portion 3 extending upwardly from the base 2. In the embodiment shown the support portion 3 is provided as a column or upright 4. The case press may be configured for use with (e.g. sized appropriately for) small arms ammunition.

A housing 5 is attached to the support portion 3 of the frame 1. An actuator 6, preferably an electric actuator, for example an electric motor, is attached to the housing 5 and/or to the support portion 3 adjacent the housing 5.

Figure 3:
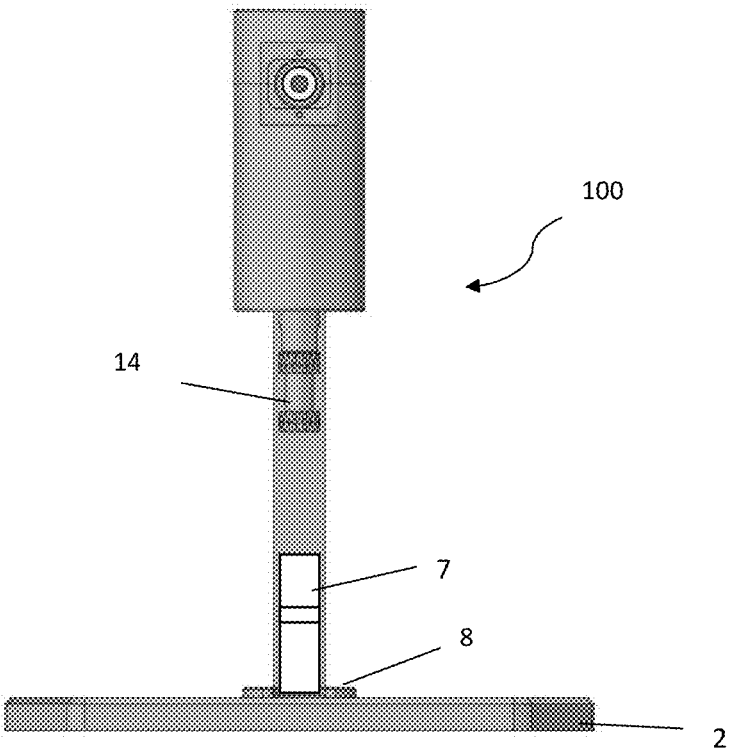
FIG. 3 is a front view of the case press of FIG. 1.
Figure 4:
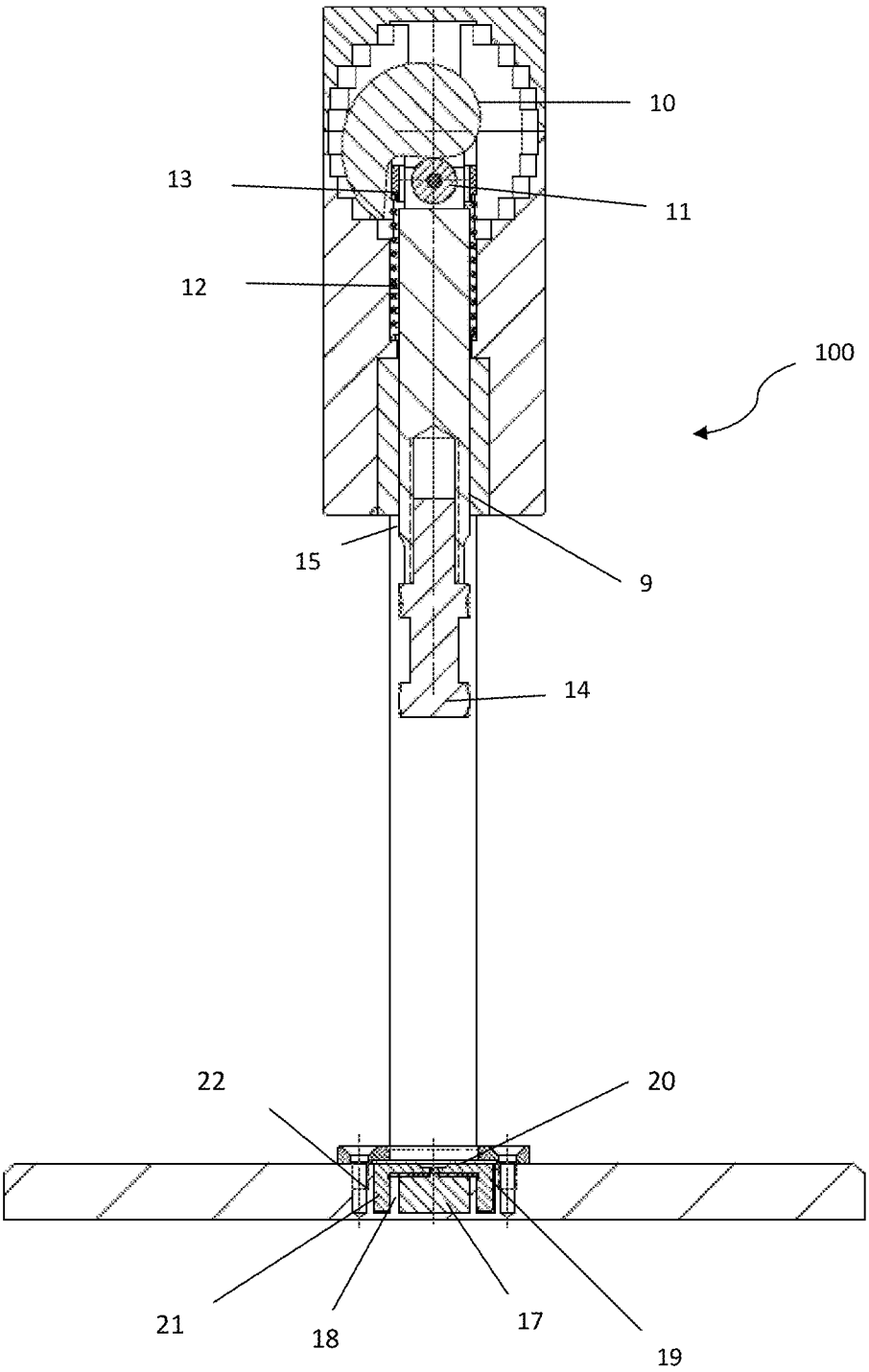
FIG. 4 is a cross-section view through plane A-A.

As shown in FIG. 3, the base 2 comprises, or is configured to engage, a die 7 for holding the cartridge and bullet, and for pressing the bullet into the cartridge. The die 7 may be fixed to the base 2, or the base 2 may be provided with a guide or socket formation 8 which holds the die 7 in a required position on the base 2, but does not restrict movement along a vertical axis. In some examples a plurality of dies may be provided, each configured to engage a different size and/or configuration of cartridge case, and a suitable die may be engaged with or mounted to the base 2 depending on the type of cartridge which is to be assembled.

A connecting member 9 extends through an aperture at the bottom of the housing 5, above the die 7. The connecting member 9 is operated by the actuator 6 via a drive mechanism. In one form of the technology, the drive mechanism comprises a cam 10 which bears against an upper end of the connecting member 9. Rotation of the cam 10 by the electric motor causes downward movement of the connecting member 9 toward the die 7. In the embodiment shown the cam 10 bears on a roller 11 provided at the end of the connecting member 9.

The connecting member 9 may be biased toward the cam 10 by a spring 12 or other resiliently flexible member which may be provided between the housing 5 and a flange 13 provided to the connecting member.

A ram 14 is connected, integral with or connectable (typically removably connectable) to the lower end 15 of the connecting member 9. In the embodiment shown the ram 14 is provided with an external thread which engages a complementary internal thread provided in a bore at the end 15 of the connecting member 9.

The die 7 may be configured to be adjustable e.g. such that the stroke or travel of the die can be adjusted. In examples the die may be provided in two pieces which are threadingly engaged together. The apparatus may comprise a plurality of dies and/or dies for use with different cases and/or bullets. Adjustable dies of the type described above are well know to those of skill in the art.

A suitable sensor is provided to determine, by direct or indirect measurement, the position of the connecting member 9, and therefore the position of the ram 14 and the displacement of the moveable portion of the die. In one form of the technology a rotary sensor 16 (e.g. an on axis magnetic rotary position sensor or a rotary encoder) is provided to measure the angle of the drive shaft and/or cam 10. This allows the position of the connecting member 9 to be calculated based on the cam profile. In alternative embodiments a linear encoder may be used.

A load cell 17 is provided to measure the insertion force exerted by the ram 14 as it presses the bullet into the case. In some forms of the technology the load cell 17 is provided between the die and the base. However, other positions are possible, for example the die may be configured to allow the case to bear directly on the load cell 17, or a load cell 17 may be provided between the ram 14 and the connecting member or between the connecting member and the cam 10. In the embodiment shown the load cell 17 is provided in a recess 18 in the base 2. A cover 19 is provided over the load cell 17. In the embodiment shown the cover 19 is in the shape of an inverted cup. The cover is positioned such that an upper surface 20 of the cover 19 is substantially coplanar with an upper surface of the base 2. The annular wall 21 of the cover 19 sits in a complementary shaped annular recess 22 in the base 2. The recess 22 is sufficiently deep to allow sufficient movement or deflection of the cover 19 under a load from the die.

By simultaneously measuring the load applied by the ram 14 on the load cell 17 (e.g. via the die), and the position of the ram 14, as a bullet is inserted into the case, a force-displacement graph can be created on a visual output device. Such a graph can provide information about the condition of the case, in particular the neck of the case.

Figure 5:
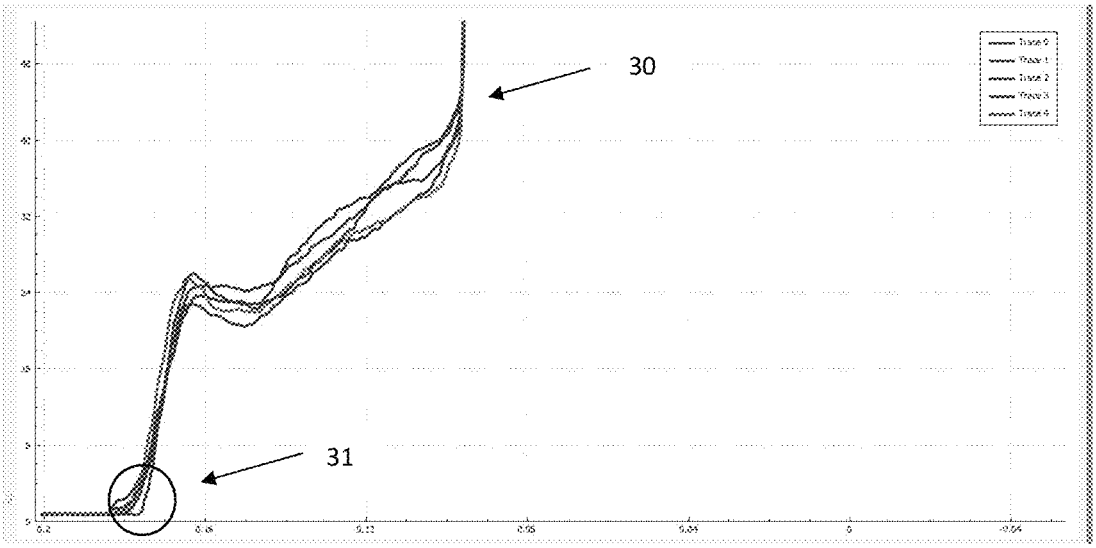
FIG. 5 is a graph of force applied to a bullet vs displacement of the bullet for a plurality of bullets being pressed into cases using a case press of the present invention.

FIG. 5 is a graph of force vs displacement for a number of cartridges. As can be seen, the traces comprise a substantially vertical spike 30 (indicating rapidly increasing force) when the relatively moveable parts of the die reach the end of their relative movement and abut each other.

As indicated by reference number 31, the force applied to each bullet rises from zero at different displacement values for different bullet/case combinations. This may be indicative of different cases having slightly different heights. This information may be used to group cartridges with similar height cases together (e.g. such that they can be used together) and/or to discard cartridges made with cases which are outside a maximum allowable variation in height. A force vs displacement graph may also be used to identify other inconsistencies in the assembly of a group of cartridges. For example, if the cartridges have been assembled using two or more different brands of bullets any difference in the length of the bullets may be apparent from this graph.

In some embodiments the sensor may be omitted. For example, provided the actuator is sufficiently powerful, it may be possible to estimate the position of the die sufficiently accurately based on the length of time since the actuator was activated. Alternatively, embodiments with no sensor may output a force-time graph (plotting the load applied to the load cell 17 against time) rather than a force-displacement graph. However, since the rate at which the bullet is pressed into the case may vary depending on the force being applied, some of the features which can easily be identified on a force vs displacement graph may be more difficult to reliably identify on a force vs time graph.

Figure 6:
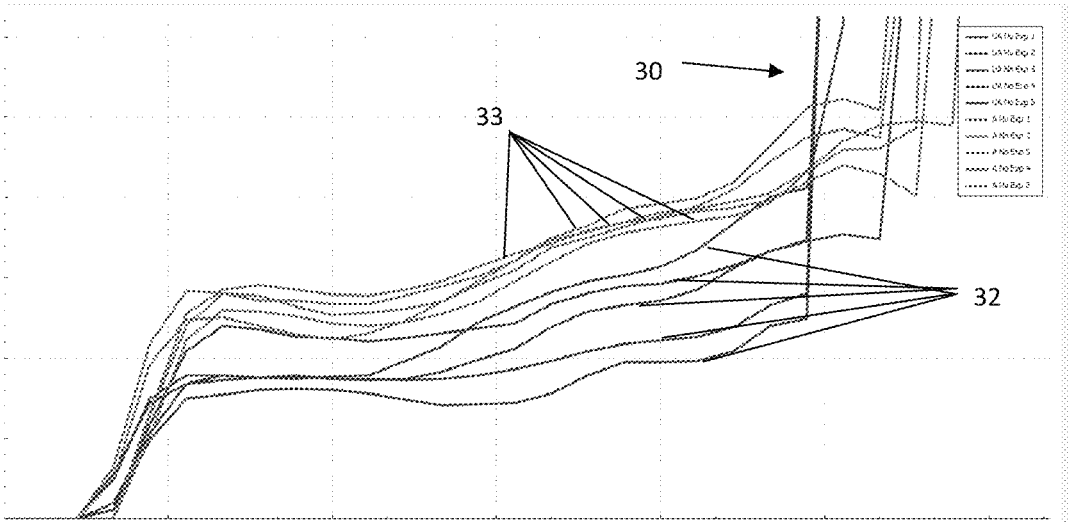
FIG. 6 is a graph of force applied to a bullet vs time for a plurality of bullets pressed into annealed cases and a plurality of bullets pressed into non-annealed cases.

FIG. 6 is a graph of force vs time for ten cartridges of the same type. Five of the traces 32 relate to cases which have been annealed and five traces 33 relate to cases which have not been annealed.

As can be seen from FIG. 6, the time taken to seat each bullet is non-uniform, even though the displacement of the bullets is substantially the same. This may make comparison of the traces from different cartridge/bullet combinations more difficult than if displacement of the bullet was measured. For example, variations in the time at which the force rises from zero (as discussed above with reference to FIG. 5) may be due to variations in the speed of travel of the ram rather than variations in the height of the cases.

As can also be seen in FIG. 6, the annealed cartridges require a lower force (for a given time/displacement) throughout the pressing process. A higher than expected force trace may be an indication that a cartridge which was believed to be annealed is, in fact, not annealed.

The visual output device may comprise a dedicated visual display unit (e.g. a monitor or screen), a general purpose computer with a monitor or screen and/or a printer.

Figure 7:
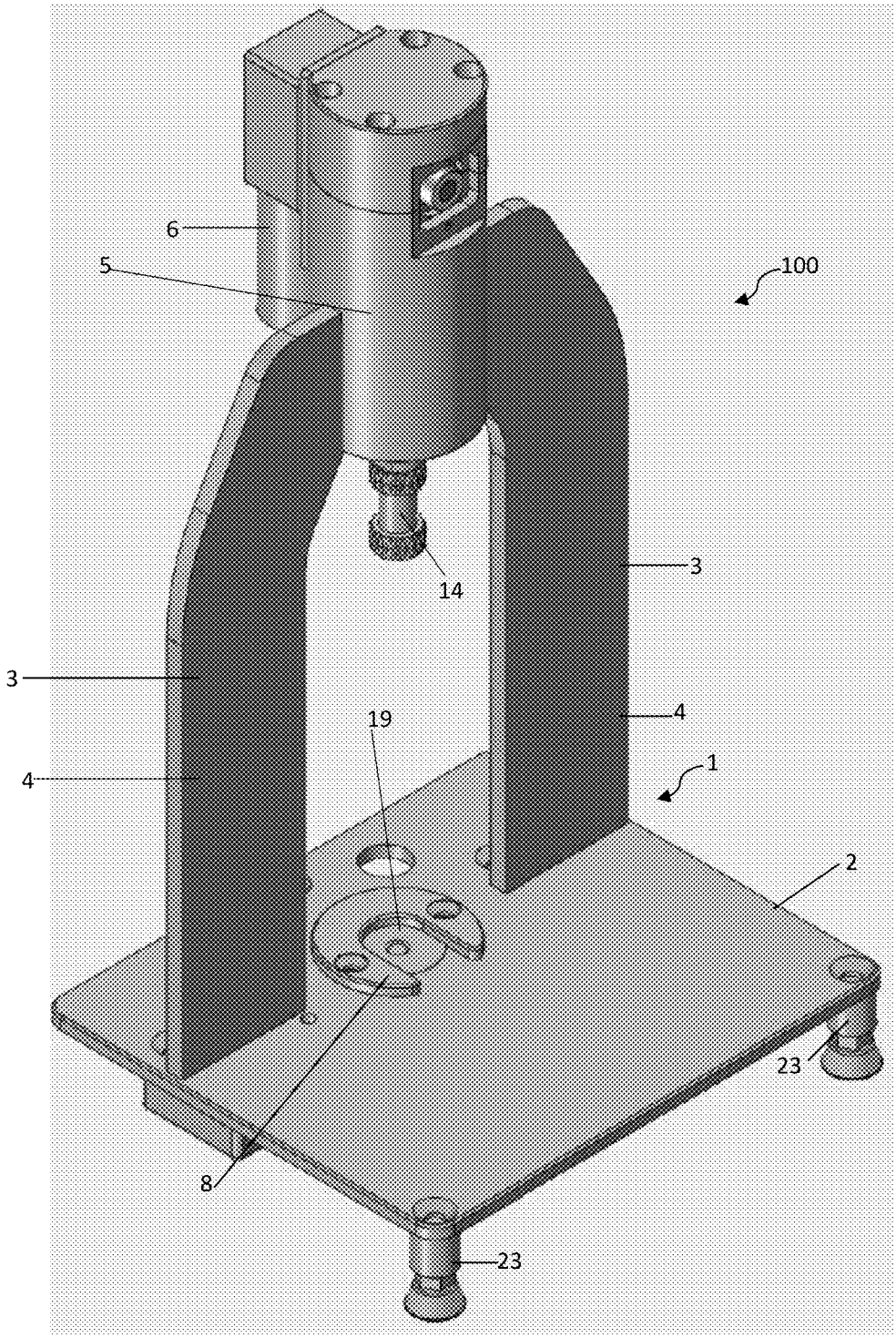
FIG. 7 is a perspective view of an alternative embodiment of the case press.
Figure 8:
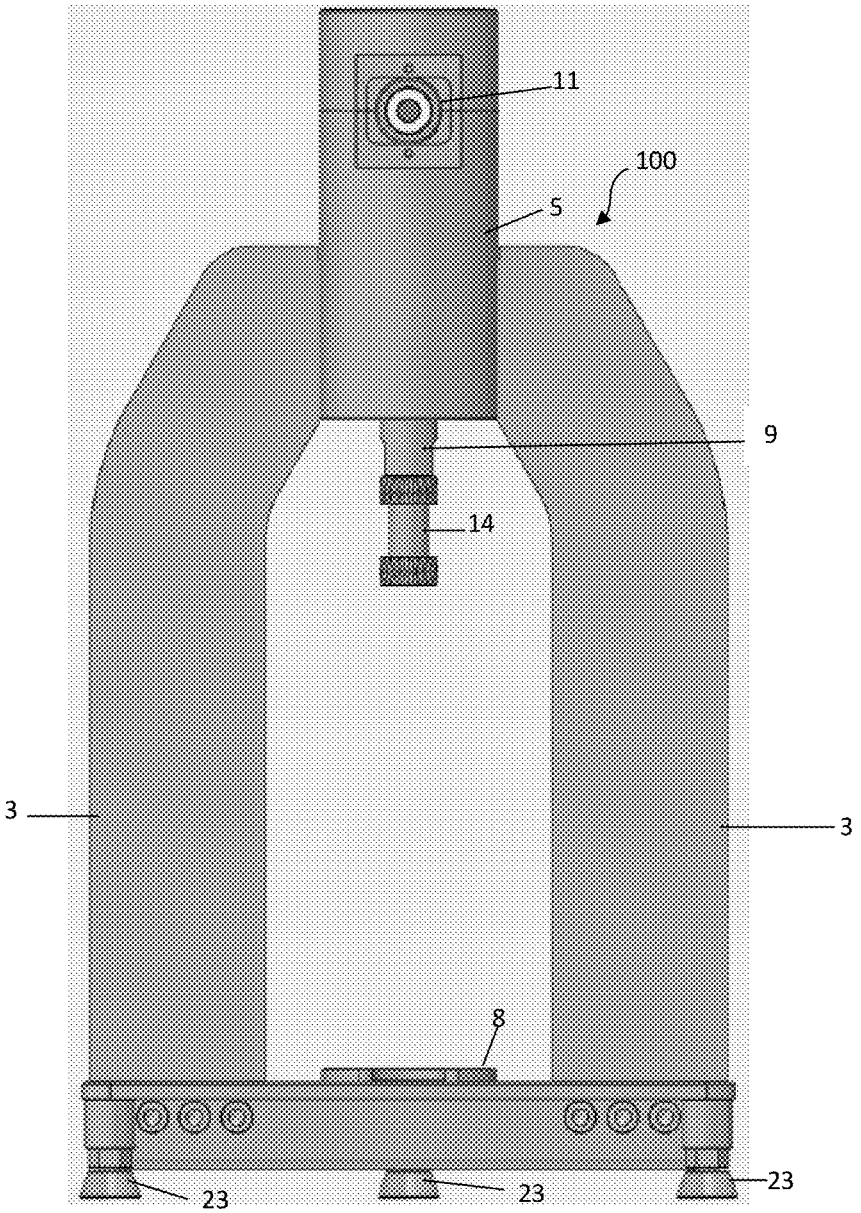
FIG. 8 is a front view of the case press of FIG. 7.
Figure 9:
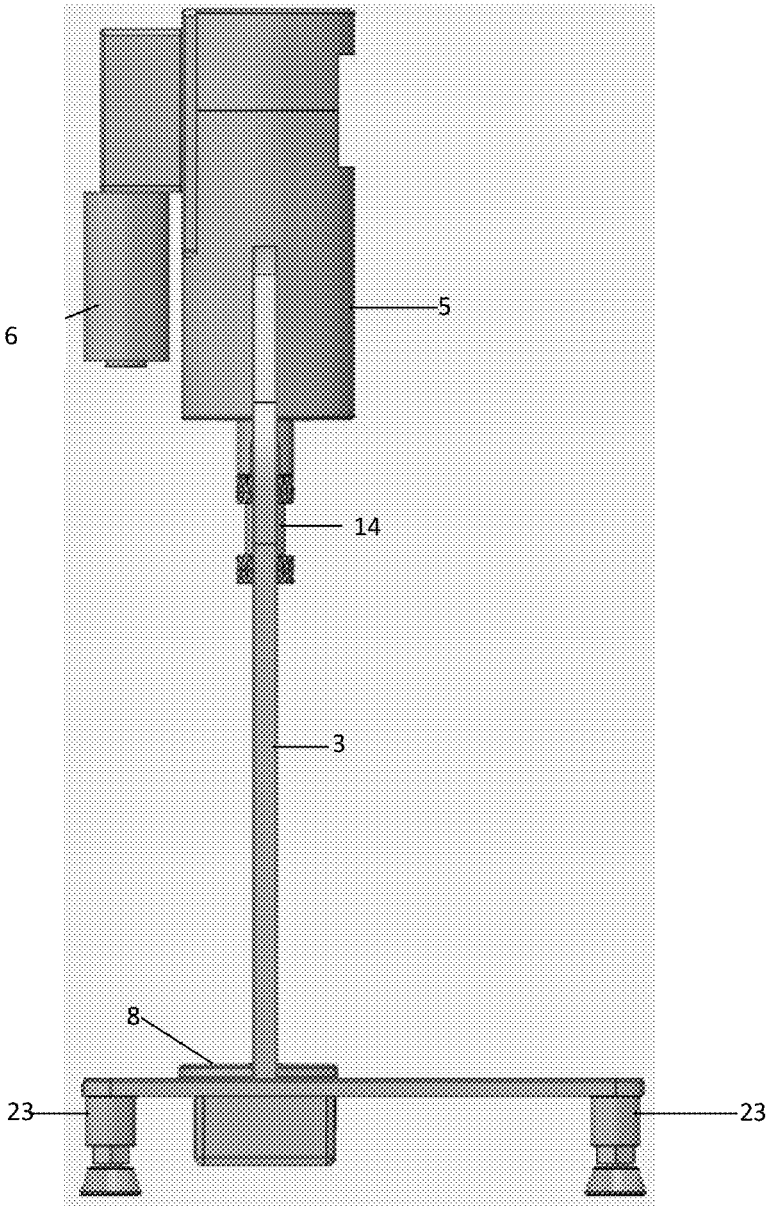
FIG. 9 is a side view of the case press of FIG. 7.

Referring next to FIGS. 7-9, another example of the case press 100 is shown. In the embodiment shown two support portions 3 are provided on opposing sides of the housing 5. The two support portions are orientated on opposing sides of the ram 9. The guide or socket formation 8 is provided between the support portions 3.

Arranging the support portions in this way increases the rigidity of the apparatus 100, and in particular reduces relative movement between the housing 5 and the base 2 when the apparatus is in use. This may increase the accuracy of the displacement measurement, allowing for more accurate mapping of force vs displacement.

In the examples shown in FIGS. 7-9, three length-adjustable feet 23 are mounted to the base.

In alternative embodiments of the invention a manual actuator, comprising a handle operable by a user, may replace the electric motor. Alternatively, the actuator may comprise a hydraulic or pneumatic cylinder.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

What we claim is:

1. A system for assembling a cartridge comprising a case press comprising a ram moveable relative to a base by an electric actuator, a sensor for determining relative movement between the ram and the base, and a load cell for measuring a load exerted by the ram on a die positioned, in use, between the ram and the base, the system further comprising a visual output device that displays a representation of the relationship between the force applied by the ram and the displacement of the ram.

2. The system of claim 1 wherein the electric actuator comprises an electric motor.

3. The system of claim 2 wherein the case press comprises a drive mechanism for driving the ram, wherein the drive mechanism comprises a cam which is configured to be rotated by the electric motor.

4. The system of claim 3 wherein the sensor comprises a rotary sensor.

5. The system of claim 4 wherein the rotary sensor is configured to measure an angular position of the cam.

6. The system of claim 1 wherein the case press comprises a connecting rod, wherein the cam bears against a first end of the connecting rod.

7. The system of claim 6 wherein the connecting rod is biased toward the cam.

8. The system of claim 6 wherein the connecting rod comprises a roller at the first end thereof, wherein the cam bears on the roller.

9. The system of claim 6 wherein the ram is connectable to a second end of the connecting rod, distal the first end.

10. The system of claim 9 wherein the ram is releasably connectable to the second end of the connecting rod.

11. The system of claim 1 wherein the load cell is provided between the base and the die.

12. The system of claim 11 wherein the base comprises a recess and the load cell is provided within the recess.

13. A system for assembling a cartridge comprising a case press comprising a frame having a base and a support portion connected to the base, the base comprising or configured to engage a die, the case press further comprising an actuator supported by the support portion, a ram moveable by the actuator toward the die, a load cell for measuring a load exerted on the die and a sensor for determining movement of the ram relative to the base, the system further comprising a visual output device that displays a representation of the relationship between the force applied by the ram and the displacement of the ram.

14. The case press of claim 13 comprising a second support portion provided on an opposite side of the ram to the support portion.

* * * * *